United States Patent [19]

Alloin et al.

[11] Patent Number: 4,607,133

[45] Date of Patent: Aug. 19, 1986

[54] LIQUID-COOLED ELECTRIC CABLE

[75] Inventors: Michel Alloin, Saint Bernard; Charles Flamand, Francheville, both of France

[73] Assignee: Les Cables de Lyon, France

[21] Appl. No.: 714,764

[22] Filed: Mar. 22, 1985

[30] Foreign Application Priority Data

Mar. 23, 1984 [FR] France ..... 84 04564

[51] Int. Cl.[4] ..... H01B 7/34

[52] U.S. Cl. ..... 174/15 WF; 174/15 C; 219/137.9

[58] Field of Search ..... 174/15 WF, 15 C, 19; 219/137.9

[56] References Cited

U.S. PATENT DOCUMENTS

| | | | |
|---|---|---|---|
| 2,320,470 | 6/1943 | Rees | 174/15 WF |
| 2,371,185 | 3/1945 | Purat | 174/19 |
| 4,006,287 | 2/1977 | Storey | 174/15 WF |

FOREIGN PATENT DOCUMENTS

| | | | |
|---|---|---|---|
| 229454 | 7/1960 | Australia | 174/15 C |
| 6609791 | 1/1968 | Netherlands | 174/15 WF |
| 784036 | 10/1957 | United Kingdom . | |
| 985794 | 3/1965 | United Kingdom . | |

*Primary Examiner*—Arthur T. Grimley
*Assistant Examiner*—Morris H. Nimmo
*Attorney, Agent, or Firm*—Sughrue, Mion, Zinn, Macpeak, and Seas

[57] ABSTRACT

A liquid-cooled electric cable for transporting very high currents at low voltages, the cable comprising a non-sealed tube (1) or other preformed duct surrounding an axial liquid flow cavity, a conductive core (3) surrounding the tube, a separation envelope (4) made of a non-conductive material, an outer conductive layer (8) which is coaxial with the conductive core, and an outer sealed sheath (13). The separation envelope is in contact with the conductive core and the outer conductive layer, and wherein it has openings suitable for allowing cooling liquid to flow between the core and the outer conductive layer.

10 Claims, 1 Drawing Figure

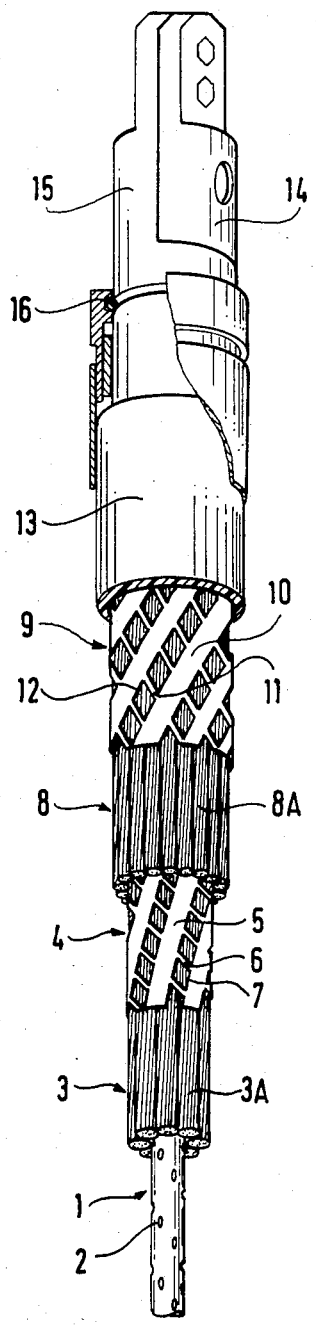
15
14
16
13
10
9
12
11
8
8A
5
4
6
7
3
3A
1
2

LIQUID-COOLED ELECTRIC CABLE

The present invention relates to a liquid-cooled electric cable for transporting very high currents at low voltages, the cable comprising a non-sealed tube or other preformed duct surrounding an axial liquid flow cavity, a conductive core surrounding the tube, a separation envelope made of a non-conductive material, an outer conductive layer which is coaxial with the conductive core, and an outer sealed sheath.

BACKGROUND OF THE INVENTION

U.S. Pat. No. 2,371,185 describes a coaxial cable comprising an internal tube built-up in non-sealed manner from rings inside the conductive core, and an insulating envelope adjoining the inside surface of the outer conductor, provided with radial holes and surrounding a cooling water circulation channel.

Such a cable does not prevent the annular cooling chambers becoming blocked at various points by virtue of the fact that its various components are held apart only by their fixing points at the two ends of the cable in tubular end pieces. This cable can thus only be short in length, and even so, it is unevenly cooled once it is bent to any significant degree.

The aim of the present invention is to provide a liquid-cooled electric cable which is effectively and uniformly cooled even if it extends over a considerable length, and whose cooling ducts are not in danger of being obstructed by various components breaking or wearing, and which provides good protection for its conductors against the mechanical forces to which it is subjected in service.

SUMMARY OF THE INVENTION

A cable according to the invention is characterized in that the separation envelope is in contact with the conductive core and the outer conductive layer, and in that it has openings suitable for allowing cooling liquid to flow between the core and the outer conductive layer.

The cable preferably includes at least one of the following characteristics:

the tube inside the conductive core is a perforated tube;

the tube inside the conductive core is a tube made up of interfitting and non-sealed circular segments;

the tube inside the conductive core is constituted by a preformed helical spring, optionally covered by a perforated envelope;

it includes a further perforated envelope between the outer conductive layer and the sheath;

the or each perforated envelope is obtained by extruding superposed layers of thermoplastic or elastomer material, with at least one of said layers being made up of helical strips;

one of the layers of the perforated envelope is formed from longitudinal strips and the other is formed from helical strips;

both layers of the perforated envelope are formed by helical strips of opposite handedness; and the conductive core and the conductive outer layer are formed from laid strands which may be laid in the same direction or in opposite directions.

BRIEF DESCRIPTION OF THE DRAWING

The sole FIGURE of the drawings shows one end of a water-cooled cable in accordance with the invention by way of example and in a partially cut-away perspective view.

MORE DETAILED DESCRIPTION

The cable comprises an axially disposed central tube 1 having perforations 2 which are regularly distributed around the tube and along its length, and which serves as a feeder for cooling liquid.

This tube could be replaced by a tube made up of interlocking circular segments which are not a watertight fit, similar to the flexible tubes used for conveying water to shower head.

The tube 1 is surrounded by a bundle 3 of conductors **3*a* which are rectilinear or which are laid to a long pitch and which are constituted by twisted strands. These conductors constitute the first conductive layer of the cable. This conductive layer is surrounded by a perforated sheath 4 made of thermoplastic or elastomer material by means of extrusion, and which is composed of helical strips 5 which are fixed to cross-strips 6 leaving openings 7**.

A second conductive layer 8 is disposed around the perforated sheath 4. The second layer is similarly constituted by laid conductors 8A.

This conductive layer is surrounded by a second perforated and extruded sheath 9 made of thermoplastic or elastomer material and formed by extrusion. This sheath is composed of helical strips 10 which are fixed to cross-strips 11 leaving openings 12. This extruded sheath 9 could alternatively be imperforate.

The structure of the sheaths 4 and 9 is such as to enable longitudinal flow of cooling water between the conductive layers and also possibly around the second outer layer in contact with these two layers.

The set conductive layers and their sheaths is covered by an outer cooling sheath 13.

The inner and outer conductive layers of the cable are respectively connected to connection fitting fittings 14 and 15 for connection either to the terminals of a resistance welding clamp or of an arc welding torch, depending on the particular cable end. The sheath 13 may be connected the end fitting by means of a rotary joint 16.

The perforated elastomer or thermoplastic material sheaths are manufactured by separately inserting the first conductive layer or the internal portion of cable or the second conductive layer into the center of an extruder, and by extruding two interconnected layers of thermoplastic or elastomer material onto the relevant conductive layer, with the inner one of the two layers being extruded by means of a punch and with the outer one of the layers being extruded by means of a die. The punch or the die may be fixed if one or other set of strips is to be longitudinal, or else it may be rotary if it is to produce a layer of helical strips.

A method and apparatus for manufacturing such layers are described in the Applicants' French patent application No. 84 02099, filed Feb. 10th, 1984.

Although the electric cable described above with reference to the sole FIGURE of the drawing appears to be the preferable form of the invention, it will be understood that various modifications may be made thereto without going beyond the scope o the invention, various component parts may be replaced by others which perform an analogous technical function. In particular, the conductive layers could be constituted by twisted conductors.

An electric cable in accordance with the invention is especially applicable to connections between welding equipment and resistance welding clamps or an arc welding torch.

We claim:

1. A liquid-cooled electric cable for transporting very high currents at low voltages, said cable comprising:

a liquid pervious tube surrounding an axial liquid flow cavity, an electrically conductive core surrounding the tube, a first, unitary separation envelope made of an electrically non-conductive material, an electrically outer conductive layer which is coaxial with the conductive core, and an outer sealed sheath, and wherein the first separation envelope is in contact with the conductive core and the outer conductive layer on opposite surfaces thereof, and wherein said first separation envelope has openings for allowing cooling liquid to flow therethrough and between the core and the outer conductive layer such that said cable is evenly cooled, even when bent to a significant degree.

2. A cable according to claim 1, wherein the liquid pervious tube inside the conductive core is a perforated tube.

3. A cable according to claim 1, wherein the liquid pervious tube inside the conductive core made up of interfitting and non-sealed circular segments.

4. A cable according to claim 1, wherein the liquid pervious tube inside the conductive core is constituted by a preformed helical spring, covered by a perforated envelope.

5. A cable according to claim 1, further including a second separation envelope between the outer conductive layer and the sheath, said second separation envelope being a perforated envelope.

6. A cable according to claim 1, wherein the first separation envelope comprises extruded superposed layers of thermoplastic material integral with each other, with at least one of said layers being made up of helical strips.

7. A cable according to claim 6, wherein one of the layers of the first separation envelope is formed from longitudinal strips and the other is formed from helical strips.

8. A cable according to claim 6, wherein both layers of the first separation envelope are formed by helical strips of opposite lay.

9. A cable according to claim 1, wherein the conductive core and the outer conductive layer are laid strands laid in the same direction.

10. A cable according to claim 1, wherein the conductive core and the outer conductive layer are laid strands laid in opposite directions.

* * * * *